US005270910A

United States Patent [19]

Kile

[11] Patent Number: 5,270,910

[45] Date of Patent: Dec. 14, 1993

[54] NEON LIGHT BOX

[76] Inventor: Edwin N. Kile, 10302 Black Walnut, Dallas, Tex. 75243

[21] Appl. No.: 839,116

[22] Filed: Feb. 20, 1992

[51] Int. Cl.[5] ..... F21V 23/00; F21S 5/00

[52] U.S. Cl. ..... 362/216; 362/222; 362/260; 40/545; 40/564; 315/DIG. 7

[58] Field of Search ..... 362/97, 216, 221, 222, 362/260, 307; 40/361, 564, 570, 545, 152.2; 315/DIG. 7, 209 R

[56] References Cited

U.S. PATENT DOCUMENTS

| | | | |
|---|---|---|---|
| 3,026,410 | 3/1962 | Azan | 362/216 |
| 4,691,267 | 9/1987 | Giesberg | 362/222 |
| 4,700,111 | 10/1987 | Folwell et al. | 315/200 R |
| 4,751,434 | 6/1988 | Helling et al. | 40/152.2 |

OTHER PUBLICATIONS

Clearr Corporation Advertising Brochure.

Clearr Corp. Price List, prices effective Aug. 1, 1990.

Fluorescent Lamps, General Electric informational brochure.

Miller, S. C., *Neon Techniques and Handling, Handbook of Neon Signa and Cold Cathode Lighting*, Third Ed., 1977, reprinted 1984–1985, Chapter XV, pp. 241–269.

Stern, Rudi, *Let There Be Neon*, 1979. Title & Contents Only.

*Primary Examiner*—Albert J. Makay

*Assistant Examiner*—L. Heyman

*Attorney, Agent, or Firm*—John W. Montgomery

[57] ABSTRACT

A thin light box comprising a thin structural frame less than about 3 inches thick for supporting a transparency to be illuminated along a frontal plane; a thin tubular cold cathode lamp between about ½ and ⅝ diameter (about 1.2 cm and 1.6 cm) having a planar serpentine configuration with a length of more than about 8 feet and less than about 16 feet which cold cathode lamp is supported within and by the frame substantially in a light tube plane parallel to the frontal plane spaced apart from the frontal plane about ¾ of an inch (about 2 cm); and a thin solid state transformer sized to fit within and to be supported by the thin frame, which solid state transformer produces a sufficiently high voltage to illuminate the cold cathode tube lamp to provide sufficient illumination for backlighting the transparency.

15 Claims, 3 Drawing Sheets

120 VAC INPUT
56
58
66
70
62
64
68
44
72
73
74
76
78
80
82
84
86
T2
T1
Q5
Q6
R6
R7
C3
C4
R10
C2
C8
R5
Q3
Q4
Q1
Q2
R3
CR1
CR2
CR3
CR4
C1
R9
CR6
R2
CR8
R1
CR7
CR5
F1
U1
C7
R8
C5
C6
R4

NEON LIGHT BOX

TECHNICAL FIELD OF THE INVENTION

The present invention relates to light boxes, and in particular to an improved thin light box for backlit displays and an illumination of large transparencies.

BACKGROUND OF THE INVENTION

Lights boxes have been known and used in the past for backlit illumination of displays and transparencies. The previously known light boxes or backlit display devices relied upon fluorescent tubular lamps to provide the backlighting illumination. The transparencies were mounted on thin sheets of plastic or acrylic material which is typically a white opaque or a clear sheet of acrylic plastic, about 1/16 to ¼ of an inch thick (about 1.5–6.5 mm). A transparency having pictures, symbols, or writings thereon could be mounted on the plane of the acrylic sheet, such that illumination from behind allowed the images to be viewed without reflective lighting. Such display devices are highly beneficial for use in low lighting indoor situations or where outdoor visibility is required during the night. Such devices have been useful as advertising displays, signage, and informational directories in restaurants, retail establishments, office buildings, and the like.

Backlighting using incandescent light bulbs or lamps has not been popular because of the high heat generation of incandescent light bulbs. Thus, light boxes have typically used standard fluorescent tubular light bulbs or lamps usually in the form of parallel, straight fluorescent tubes which are about 1½ inch in diameter (about 3.8 centimeters diameter) which are spaced apart horizontally or vertically along the rear of the light box to form a substantially even lighting plane. Circular fluorescent tube lamps have been used in some cases where the display area is small. In order to avoid observable bright lines through a plastic transparency along each fluorescent tube (such bright lines are commonly referred to as "hot spots"), the light plane must be spaced apart a sufficient distance from the transparency to allow the light from each tube to adequately diffuse before illuminating the transparency. Even for opaque plastics or clear plastic with a diffusion coating or a thin paper covering, each of which provide a certain amount of light diffusion, the minimum diffusion distance from the bulb surface to avoid hot spots is in the range of about ¾ of an inch to 1½ inches (about 2 centimeters to about 4 centimeters). As a result of the combined fluorescent tube diameter and the required diffusion distance, as well as construction or structural requirements of the light boxes, previously known light boxes have been about 4 or 5 inches deep (about 10 to 13 centimeters) with the minimum previously known light box of the type using standard fluorescent tubes, about 3¼ inches deep.

The transformers used in previously known light boxes were typically the standard magnetic coil ballasts for fluorescent lighting, which are generally bulky, heavy units which convert standard house current such as 120 volts AC at 60 cycles per second into 700–800 volts AC at 60 cycles. Spacing requirements for such transformer ballasts could usually be accommodated by the 4 or 5 inch deep light boxes. However, in the case of some thin light boxes with a depth of about 3¼ inches, the spacing requirements as well as the structural requirements caused the cost of manufacturing such units to be increased compared to deeper light boxes. Typical life span for fluorescent lamps is about 2,000–4,000 hours of continuous illumination. The life span is shorter in illuminated hours when the units are turned on and off frequently and failures may be expected after about 1,000 starts, or less.

There has been a need for thin light boxes which, for example, can be wall mounted without recessing the box into the wall. However, entirely adequate solutions to the various problems associated with constructing a thin light box have not previously been known. One thin light box using a large number of very small diameter fluorescent tube lamps has been produced. The resulting light box has a depth of approximately 1¾ inches, but is very expensive to manufacture and maintain. These light boxes use small diameter straight fluorescent lamp tubing, approximately ¼ of an inch (about 6 mm) in diameter. The thin profile of these light boxes also requires a special electronic ballast to produce the appropriate voltage required for the fluorescent tubular lamps. The typical life span for the very small diameter fluorescent lamps can be less than about 500 hours of continuous use and shorter for frequent starts. This is particularly disadvantageous where a larger number of small diameter fluorescent lamps are required to provide the same intensity of illumination as provided with the larger diameter fluorescent bulbs.

SUMMARY OF THE INVENTION

The present invention overcomes many of the problems associated with the previously known light box constructions and in particular, provides a construction having a thin profile or depth of less than about 3 inches and preferably about 1¾ of an inch (about 4.5 centimeters). The illumination is provided with small diameter cold cathode lamp tube or typically known as a neon-type lamp construction as opposed to hot cathode fluorescent light tubes or fluorescent lamps. The neon lamps have a longer total length for each lamp and are fashioned in a serpentine planar arrangement so that fewer separate tubes are required for a given display size. Typical display sizes of approximately 4 ft.$^2$ can be adequately illuminated with a single serpentine shaped neon lamp tube having a total length of up to about 16 feet (about 4.9 meters). The neon lamp is powered with a high voltage solid state transformer control circuit which is uniquely constructed onto a narrow thin strip circuit board, such that it conveniently fits within a shallow depth of a thin light box frame and can be substantially hidden by a narrow border around the light box transparency display area.

Unless otherwise specifically defined, a convention will be adopted throughout this application that the terminology "neon light tube" and "neon lamp" are intended to refer to a gas-filled cold cathode tubular lamp having an interior which is either coated or uncoated with phosphors and which may be filled with neon, argon, krypton, or another gas, or a mixture of gases, and/or metallic vapors.

It is one object of the present inventive light box to provide a thin light box illuminated with a small diameter high voltage cold cathode light tube. More specifically, a small diameter glass tube cold cathode lamp filled with argon and a small amount of liquid mercury and having a phosphors coating is provided in a thin light box.

It is a further object of the invention to provide a backlit construction in a thin light box having a neon light tube in combination with a high voltage solid state transformer control which fits entirely within the light box frame. The transformer circuit is constructed for efficient low heat generation during operation at a voltage, current and a frequency which is adjusted to provide a sufficiently high intensity light. The combination results in a thin light box which is comparable in visibility to much deeper fluorescent tube light technology.

It is a further object of the invention to maximize the efficiency and effectiveness of the light produced with the neon light tube over a maximum display area. A planar serpentine neon light tube construction is provided for this purpose.

It is a further object to obtain an increased illumination effectiveness with the same length light tube. A reflective border uniquely serves the purposes of increasing the area of appropriately diffused light illumination. Also, the reflective border shields the internal transformer from view. The chance of careless contact with the transformer when the cover is removed or replaced is also reduced.

BRIEF DESCRIPTION OF THE DRAWINGS

These and other objects, advantages, and benefits of the invention will be more fully understood with reference to the description, claims, and drawings below in which like numerals represent like elements and in which:

DETAILED DESCRIPTION OF THE DRAWINGS

Figure 1:
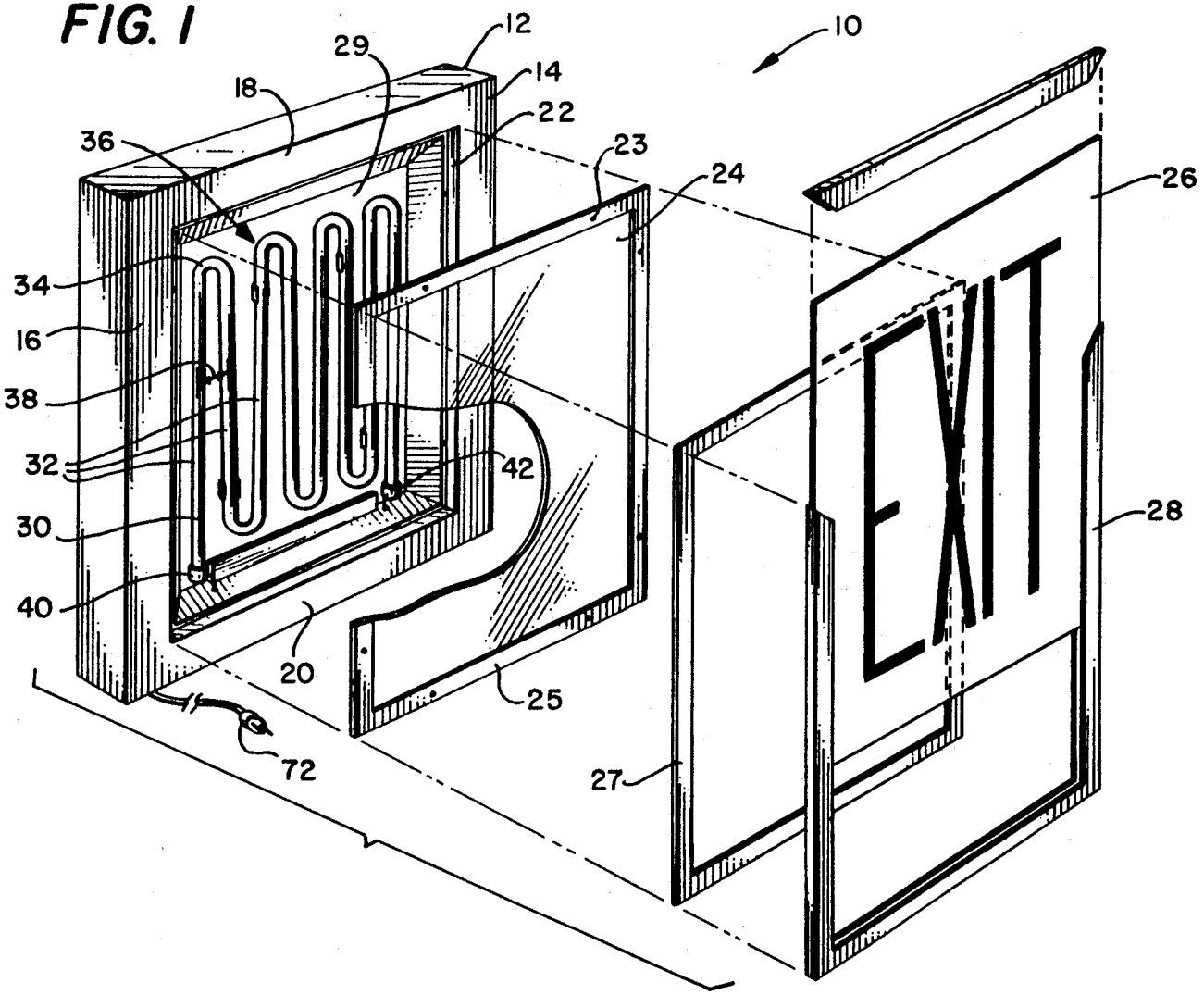
FIG. 1 is a perspective view of an inventive light box according to the present invention in which its use with a replaceable transparency is demonstrated with a side bracket.
Figure 2:
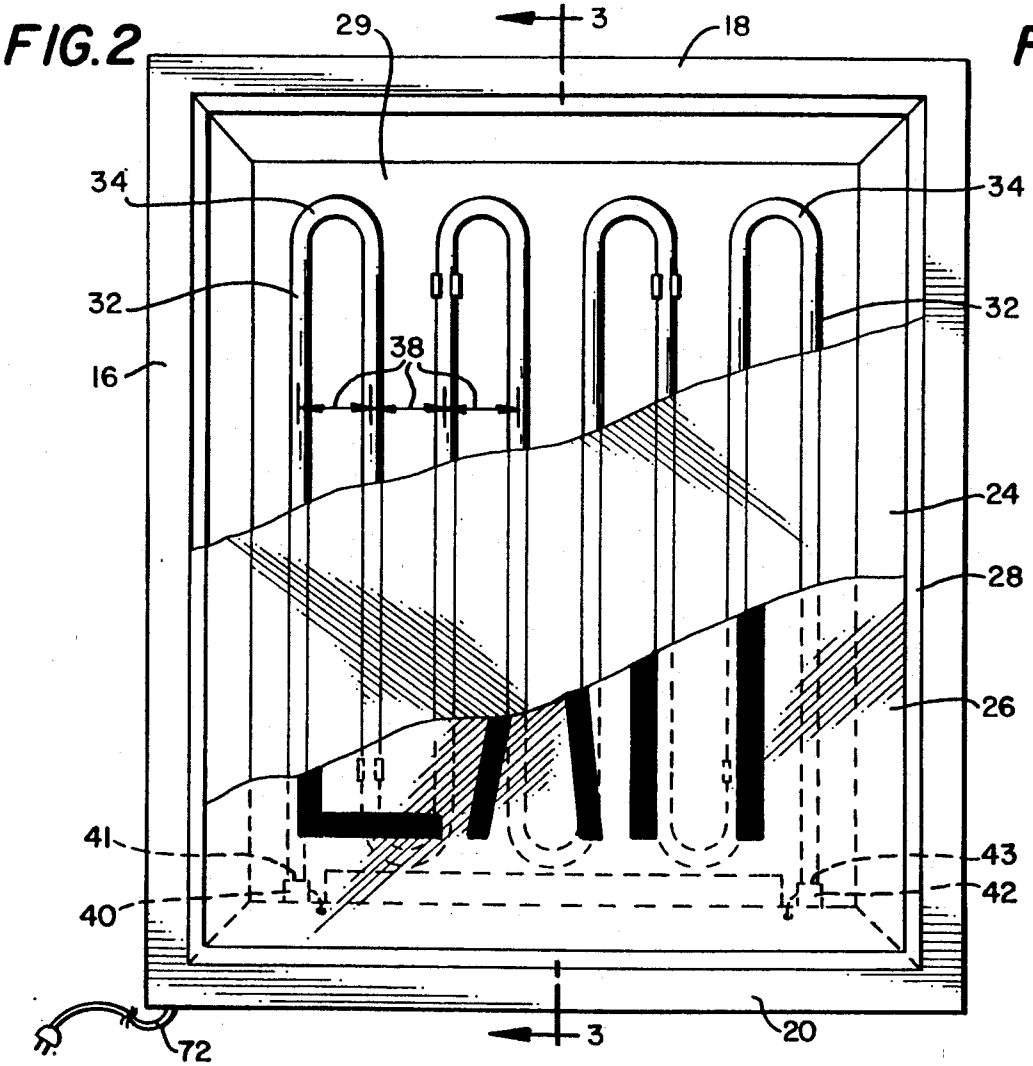
FIG. 2 is a front plan view of the light box according to the present invention.

With reference to FIGS. 1 and 2, in which FIG. 1 is a perspective view and FIG. 2 is a front plan view of a light box according to the present invention, the light box 10 may be more fully understood. Light box 10 comprises a frame 12 which may be fashioned of substantially rigid structural frame members composed of wood, molded plastic, extruded plastic, metal, extruded metal, and the like structural members. Preferably, frame 12 is composed of extruded plastic having parallel first side 14 and second side 16 and parallel top 18 and bottom 20 fastened together at the corners as by plastic glue or plastic welding or other fastening means. The frame 12 is preferably less than about 3 inches deep and advantageously less than about 2 inches deep and provides an inwardly projecting ledge 22 to which an acrylic cover 24 can be mounted to close the front portion of the light box fastening means 23, such as threaded fasteners which seal the acrylic cover into place.

A transparency 26 is removably held in place immediately adjacent the cover 24. This can be advantageously accomplished using corresponding magnetic strips 25 and 27 mounted respectively to the periphery of cover 24 and a border 28 around the transparency. Any number of replaceably attachable transparency constructions might be used without departing from the thin light box invention. A back plate 29 is provided supported from the rear of frame 12 preferably to entirely enclose the lamp tube and electrical components within the light box.

A cold cathode lamp tube 30 is preferably made of a small diameter glass tubing in a range of about $\frac{3}{8}$ to about $\frac{3}{4}$ of an inch (about 10–20 mm) and advantageously in the range of about 12–15 millimeters. Slightly smaller or larger tubes may be used; however, either the thinness or the brightness of the light box will be compromised. Thin light boxes less than about 3 inches can be advantageously formed. Twelve millimeter tubing has been found advantageous to provide a thin box about $1\frac{3}{4}$ inch deep, while maintaining sufficient light intensity and even light diffusion. The light tube is preferably fashioned in a serpentine arrangement with parallel vertical straight sections 32 alternatingly connected at the tops and at the bottom with curved portions 34. The fronts of all the tubes are even to thereby define a light tube plane 52 with the planar serpentine construction 36. The vertical sections 32 are advantageously consistently and uniformly spaced a distance 38 between each vertical tube for even light distribution and proper diffusion in the light box.

Figure 3:
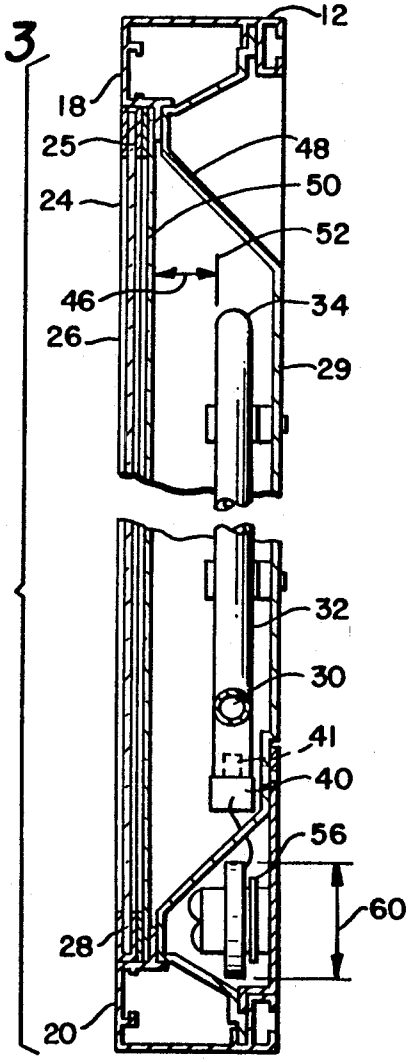
FIG. 3 is a cross-sectional side view taken along section line 3—3 of FIG. 2.
Figures 4, 5:
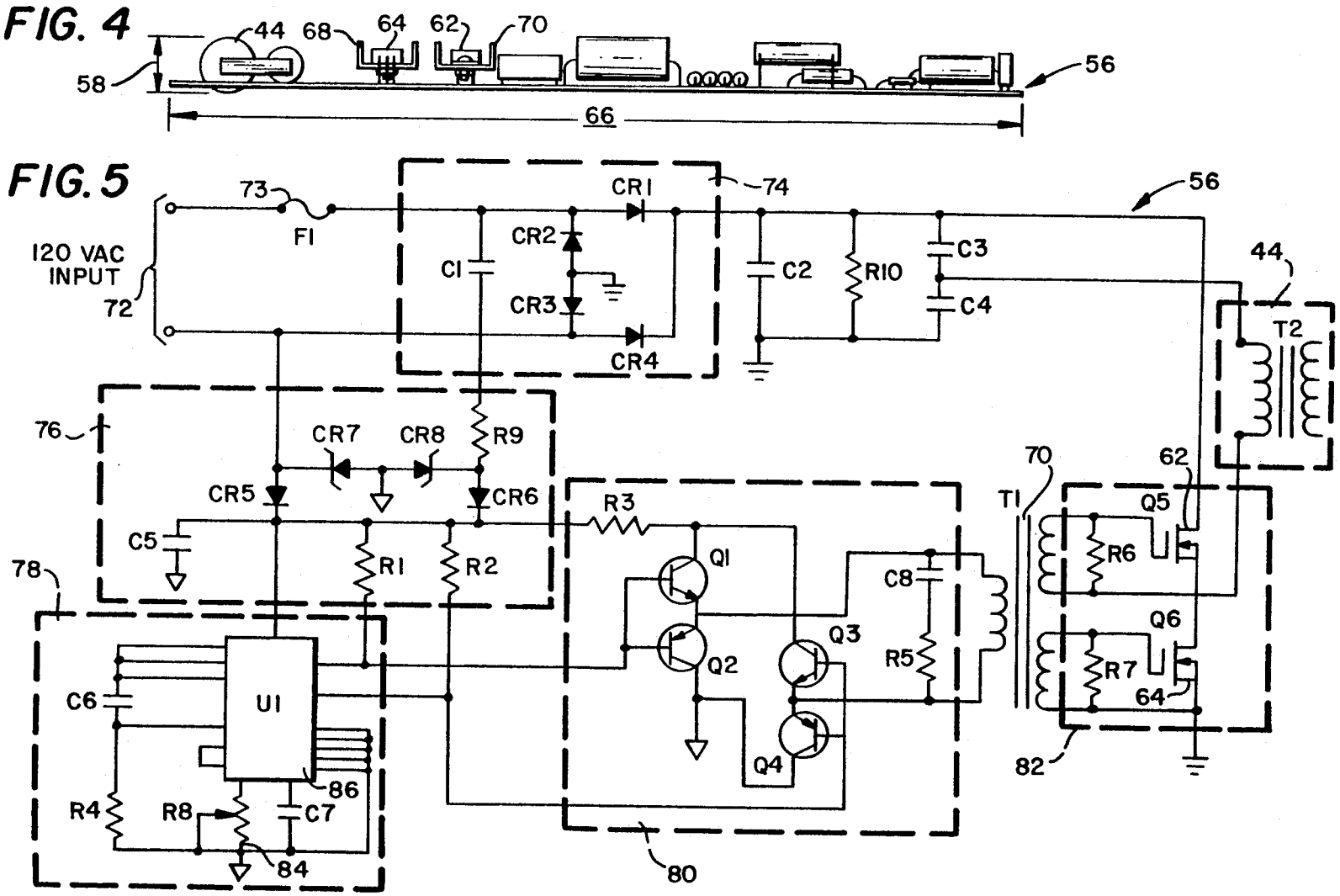
FIG. 4 is a side plan view of the transformer circuit board according to the present invention.
FIG. 5 is a schematic circuit board diagram of the unique solid state transformer control circuit of the present invention.

The cold cathode light tube 30 has a first end connector 40 and a second end connector 42, which are connected to respective cold cathodes 41 and 43 and from which the light tube 30 obtains high voltage and high frequency electrical power from a transformer 44 (shown in FIGS. 3 and 4). A rare gas within the glass tube is thereby ionized and conducts the current between the cold cathodes at either end. The rare gas is preferably primarily argon gas, which is mixed with a small amount of liquid mercury. Argon is advantageous for its low resistance characteristics, although other rare gases might be used for shorter lamps or with higher transformer output voltages. There is a phosphors coating on the inside of the glass tube which is activated by the ultraviolet light energy from electrically excited gas and mercury vapor mixture to provide visible light illumination. The particular light spectrum depends upon the gas mixture and the particular phosphors coating used. A daylight 6500° Kelvin light is preferred for appropriate illumination in the shallow cold cathode light box of the present invention.

With reference to FIG. 3, which is a side cross-sectional view taken along line 3—3 of FIG. 2, the advantageous thin or shallow depth construction of the light box 10 can be more fully understood. The front cover 24 defines a frontal plane 50 for supporting a transparency 26 to be illuminated. The thin tubular neon-type light bulb defines, along its frontal portion, a light tube plane 52 which is parallel to the frontal plane 50 at which the transparency 26 is to be illuminated. A minimum light diffusion distance 46 is defined between the frontal plane 50 and the light plane 52. It has been found that a minimum diffusion distance 46 of about $\frac{3}{4}$ of an inch (about 2 centimeters) allows diffusion between each of the tubes and the front planar surface to thereby avoid hot spots or visibly observable bright lines along each of the vertical straight portions of the light tubes.

Preferably, a reflector 48 is interposed adjacent at least one edge of the frame to shield the transformer from view and preferably along each edge of the frame between the frontal plane 50 and the rear panel 29 at an angle which is preferably about 45° with respect to the display plane 50. It has been found that by interposing the 45° angle reflector, the spacing 38 between each of the vertical lamp tube members can be decreased, thereby maximizing the high intensity light coverage by the cold cathode luminous tube for a given length of tube. The reflector panels 48 increase the efficiency of providing reflected light from the lamp tube 30 to the transparency 26 The reflectors also facilitate even light diffusion throughout the transparency panel. As will be explained more fully below, the unique solid state transformer circuitry 44 is designed to efficiently provide a sufficiently high voltage and high power to provide a high intensity light comparable to hot cathode fluorescent lamps of much larger diameters, and to adequately illuminate the transparency without a reflector. It has nevertheless been found to be advantageous to provide the reflector 48 and thereby further increase the size capabilities of the light box for a given length of lamp tube.

In one example of an extremely beneficial light box having a transparency display dimension of approximately 2 feet by 2 feet, a neon-type light tube (i.e., a cold cathode luminous tube) having a total length of 16 feet and a diameter of 12 millimeters has been found to work very well with a start voltage of about 2,400 volts at about 30–40 Khz and a current of about 42 milliamperes. The continuous operation voltage after full ionization of the argon gas and mercury vapor mixture is about 1,800 volts.

FIG. 4 is a front plan view of the smaller configuration solid state transformer circuit 44 on a circuit board 56 by which the lighting box is to be powered. So that the entire transformer 44 and circuit board 56 fits within the 1¾" thin light box, the front to back dimension 58 or the depth 58 of the board is uniquely about ¾ inch and the top to bottom dimension 60 or the height 60 is about 1¼ inch. It has been found advantageous to have an elongated transformer circuit board 56 having a length 66 which is about 12 inches long in order to space the various heat generating and dissipating components apart from other operating components. The primary heat generating components are the output transformer 44 and the solid state power components or FET units 62 and 64. These are thus preferably spaced apart at one end of circuit board 56. In particular, it has been discovered that by selecting FET units with 0.8 ohm RDS on (resistance drain source with the FET conducting electricity or "on") ratings, the heat generation in the FET units is minimized (about 3–12° C. temperature rise in the light box during operation) and can be easily accommodated with acceptably small aluminum heat sinks or heat dissipating units 68 and 70.

An efficient high quality output transformer 44 has been selected specifically for an input voltage of about 160 volts and an output of 2,400 volts operating at a frequency selected of about between 20–50 Khz so that it generates only a small amount of dissipatable heat. Thus, the FET units have been carefully and uniquely selected and optimized for operating at voltages well below a standard maximum rating for such units of about an input voltage of 260 volts. Preferably, the 110–130 volts AC input is converted in a rectifier and filter circuit 75 to a voltage of about 160 volts D.C. The converted and rectified portion of the input current which is now at 160 volts D.C. is alternatingly allowed to flow back and forth through the primary coil of transfer coil 44 where it is further transformed to an output of about 2,400 volts. The frequency of between about 20 to 50 kHz is selected with the use of adjustable frequency circuit 78 which provides a signal to establish the frequency within frequency generating circuit 80 which is preferably a flip-flop circuit 80. The frequency generating circuit 80 operates through a primary winding of drive transformer 70 which is inductively coupled with field effect transformers or FETs 62 and 64, thereby causing the portion of the input current which is 160° D.C. volts to flow in alternate directions through the primary winding of transformer 44." In this unique arrangement the high output voltage from the solid state transformer control circuit in the range of about 20–50 kHz frequency at about 43 milliamp current. The heat dissipation is minimized. The high efficiencies resulting from the particular FET power units (preferably 260 voltage rated and 0.8 ohms RDS on) and the specific output transformer uniquely and advantageously result in a thin, self-contained power supply for a thin light box construction.

FIG. 5 is a schematic circuit board diagram of the unique solid state transformer control circuit. The circuit 56 includes an input 72 for receiving standard household current at about 120 volts AC, 60 cycles per second. For safety, there is a fuse 73 interposed between the input voltage supply 72 and a rectifier circuit 74. A portion of the rectified current is provided through a voltage dropping circuit 76 to a frequency solid state control circuit is operatively interconnected with a frequency generating circuit 80 by which a portion of the rectified current from rectifier 74 is converted into high frequency alternating current. The current and voltage from transformer 44 is connected through connectors 40 and 42 to luminous tube cold cathodes 41 and 43. The output from the frequency generating circuit 80, which output is a low voltage high frequency alternating current, is provided to the primary coil of the drive transformer 70. This inductively couples the primary coil with the two secondary windings of drive transformer 70. The two secondary windings are connected to field effect transistors (FETs) 62 and 64 so that the FETs are alternatingly turned on and off to allow the portion of the input current which was converted to 168 volts D.C. to alternatingly flow through the primary coil of transformer 44. The primary coil of transformer 44 therefore effectively receives an input 160 volts AC at the frequency controlled by circuit 78 and generated in frequency generating circuit 80. Drive transformer 70 inductively couples the alternating frequency current from circuit 80 with the power control circuit 82 which comprises the field effect transistors 62 and 64. These field effect transistors 62 and 64 alternatively turn on and off to supply a primary coil of an output transformer 44 at which the input power voltage of about 160 to 170 volts is increased by a factor of between 11 and about 15, for an output voltage in the range of about 1,800 to 2,400 volts.

The cold cathode luminous tubes operate quite efficiently at between 20 and 50 kHz without substantial or noticeable difference in the illumination generated which is primarily dependent upon the voltage and current being conducted by the ionized argon, mercury vapor mixture. However, the output current of the control circuit is dependent on the operating frequency such that the frequency control unit 78 is used to control the power to the luminous tubes. For this purpose, a variable potentiometer 84 is provided in connection with the solid state transistor chip 86 of the frequency control circuit. By varying the resistance in potentiometer 84, the frequency response of transistor chip 86 is adjusted thereby permitting an adjustable power and therefore, and adjustable brightness control. In particular, it has been found that the higher frequencies of about 50 kHz result in a lower power output of about 20 milliamps, while a lower frequency of about 30 to 40 kHz results in a power output of about 40 to 45 milliamps. Thus, it has uniquely been found that in connection with a small diameter luminous tube of the cold cathode or neon-type construction which tube is between 8 and 16 feet long, can be operated with a solid state transformer control circuit and corresponding high efficiency transformer which can be sized and constructed for fitting within the thin dimensions of a light box. The thinness of the light box is currently limited by the diameter of the luminous tube and a minimum required diffusion distance, and the transparency supporting structure. This unique combination permits wall-mounted backlit displays which are not substantially deeper than ordinary picture frames, and which do not require indentation in the walls to avoid an awkward aesthetic appearance.

A transformer control and circuit board 56 of about ¾ inch by 1¼ inch by 12 inches, as indicated, can be advantageously placed within the light box and adjacent a border so that it is substantially hidden from view by the border. Preferably and for aesthetically pleasing benefits, the border is the same width entirely around the periphery of the light box. A narrow border in the range of about 1 to 2 inches wide can be advantageously obtained according to the present invention. It has also been found to be advantageous to use an angled reflector 48 around the interior periphery of the light box display area which serves to completely hide the transformer and control circuitry. This construction thereby avoids shadows or reflective light inconsistency as might inadvertently result from color variations in the components of the circuitry.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

What is claimed is:

1. A thin light box comprising:

(a) a thin structural frame less than about 3 inches (about 8 cm) for supporting a transparency to be illuminated along a frontal plane from behind;

(b) a thin tubular cold cathode lamp having a diameter between about ⅜ of an inch and ¾ of an inch (between about 10 mm and 20 mm) supported within the thin frame substantially in a plane parallel to the frontal plane and spaced apart therefrom by a diffusion distance;

(c) a thin solid state control and transformer circuit sized to fit within and to be supported by the thin frame and which is operatively connected to the thin cold cathode lamp to provide it with a sufficiently high voltage to illuminate the cold cathode tubular lamp to provide sufficient illumination for backlighting the transparency, said solid state control and transformer circuit comprises a circuit for transforming a first portion of standard household alternating current input at about 110 to 130 AC volts at 60 cycles per second into an output current between about 35 and 45 milliamperes at a voltage between about 1,800 and 2,400 volts and between about 20 kHz and 50 kHz.

2. A thin light box as in claim 1 wherein the thin structural frame has a maximum thickness of about 1¾ of an inch about 4.5 cm).

3. A thin light box as in claim 1 wherein the thin tubular cold cathode lamp is constructed of tubular glass having a diameter of between about ½ of an inch and ⅝ of an inch (between about 12 mm and 16 mm).

4. A thin light box as in claim 1 wherein the thin tubular cathode lamp comprises a glass tube having a length greater than 8 feet.

5. A thin light box as in claim 4 wherein the length of the cold cathode lamp is between about 8 feet and 16 feet.

6. A thin light box as in claim 1 further comprising:

(a) a uniformly narrow border around the frontal plane of the structural frame which border is between about 1 and 2 inches (about 2.5 cm and 5 cm) wide; and (b) wherein the thin solid state control and transformer circuit is constructed with sufficiently small dimensions to be enclosed within the frame and to be obscured from view behind a portion of the border.

7. A thin light box as in claim 1 wherein:

(a) the transformer and control circuit further comprises a rectifier and voltage reduction circuit to rectify and reduce the voltage of a second portion of the input current; and (b) a solid state frequency control circuit electrically connected for receiving said second portion of current, said solid state frequency control circuit having a semiconductor chip and a variable resistance RC frequency control circuit for selectably varying a frequency signal from said semiconductor chip for controlling the frequency of the output current within the range of about 20 kHz and 50 kHz.

8. A thin light box as in claim 1 wherein the thin structural frame further comprises:

(a) parallel side border portions;

(b) parallel top and bottom border portions fastened at corners to the parallel side portions to form a rectangular shaped frame;

(c) an interior ledge projecting a short distance inward from the border portion;

(d) a light transmission cover fastened to the interior ledge portion with the rectangular border therearound;

(e) a back portion interconnected with the side and top and bottom frame portions for enclosing the light box;

(f) means for holding the thin tubular cold cathode lamp adjacent the back portion and spaced apart a minimum diffusion distance of about ¾ inch from the light transmission cover; and (g) means for removably holding a transparency to be illuminated adjacent the light transmission cover thereby forming the frontal plane of the light box.

9. A thin light as in claim 8 further comprising:

(a) a reflective border angled between the ledge portion of the border and the back plate surrounding the thin cold cathode lamp to further reflect light onto the light transmission cover at the frontal plane.

10. A thin light box as in claim 1 wherein the thin tubular cathode lamp comprises a glass tube formed in a planar serpentine configuration for substantially uniform light production along a plane spaced apart from the frontal plane a minimum diffusion distance greater than about ¾ inch.

11. A thin light box as in claim 10 wherein the thin tubular cold cathode lamp which is formed into a serpentine configuration has a length of between 8 feet and 16 feet.

12. A thin light box as in claim 10 wherein the serpentine configuration comprises spaced apart parallel straight portions of the lamp tube alternatingly interconnected with curved end portions, such that the straight portions are spaced apart a consistent distance across the entire width of the light box display area interposed between the side and top and bottom frame portions.

13. A thin light box comprising:

(a) a thin structural frame about 1¾" thick (about 4.5 cm) for supporting a transparency to be illuminated along a frontal plane of a light transmitting cover having about 4 square feet of surface area and said frame having a border of about 1 to 2 inches width;

(b) a thin tubular cold cathode lamp between about ½" and ⅝" diameter (about 1.2 cm and 1.6 cm) having a planar serpentine configuration with a length of more than about 8 feet, and less than about 16 feet with parallel portions evenly spaced apart from each other parallel portion and adjacent to the light transmission cover to provide substantially uniform lighting therebehind, which cold cathode lamp is supported within and by the frame substantially in a light tube plane parallel to the frontal plane spaced apart from the frontal plane about ¾ of an inch (about 2 cm); and (c) a thin solid state controlled transformer sized to fit within and to be supported by the thin frame substantially hidden along and behind one ;border portion and designed to convert standard household 60 cycle per second AC current at 110 to 130 volts to an output voltage for powering the cold cathode lamp at a voltage of between 1,800 and 2,400 volts at 20 to 50 kHz and between about 35 and 50 milliamps, which transformer produces a sufficiently high voltage to illuminate the cold cathode tube lamp to provide sufficient illumination for backlighting the transparency.

14. A thin light box as in claim 13 further comprising a reflective border portion interposed around the thin tubular cold cathode lamp and the frontal plane at which the transparency is to be supported such that light from the tubular lamp is further reflected and diffused onto the frontal plane at which the transparency is located, thereby reducing the area across which the cold cathode lamp serpentine configuration is evenly spaced so that the light intensity is further intensified and diffused on the transparency for increased illumination.

15. A thin light box as in claim 9 wherein said transformer and control circuit further comprises:

(a) another rectifier and a filter for receiving the first portion of the input current at the standard household voltage and producing a current with a D.C. voltage, which voltage is stepped up by a factor of about 1.4;

(b) a pair of field effect transistors with source terminals, gate terminals, and drain terminals operatively connected at the source terminals thereof to the stepped up D.C. voltage from the rectifier and filter and connected through a frequency generating flip-flop circuit and a drive transformer to the frequency output of the control circuit at the gate terminals, such that the transmission of power therethrough is operatively controlled by the frequency control circuit; and (c) a second transformer operatively connected to the drain terminals of the field effect transistors to further transformer the voltage alternatingly transmitted from the drain terminals through the second transformer by a factor of about 15 so that the output voltage and current is in the range of about 1,800 A.C. volts to about 2,400 A.C. volts, and which output voltage and current is supplied to the cold cathode lamp to provide electrical power in a range between about 35 milliamps and 45 milliamps.

* * * * *

UNITED STATES PATENT AND TRADEMARK OFFICE

CERTIFICATE OF CORRECTION

PATENT NO. : 5,270,910

DATED : DECEMBER 14, 1993

INVENTOR(S) : EDWIN N. KILE

It is certified that error appears in the above-identified patent and that said Letters Patent is hereby corrected as shown below:

In the Abstract:

Line 3, insert ---"--- following "1/2" and ---"--- following "5/8".

Column 5, line 58, insert ---selected--- before "frequency".

Column 5, line 63, delete "about", and insert ---about--- following "of".

In the Claims:

Claim 2 at Column 8, line 7, insert ---(--- before "about".

Claim 13 at Column 9, line 39, delete ";".

Claim 15 at Column 10, line 16, replace "19" with ---7---.

Signed and Sealed this

Fourth Day of April, 1995

*Attest:*

*Attesting Officer*

BRUCE LEHMAN

*Commissioner of Patents and Trademarks*